US007134310B2

(12) United States Patent
Hu

(10) Patent No.: US 7,134,310 B2
(45) Date of Patent: Nov. 14, 2006

(54) TUBE BENDER

(75) Inventor: Ping-Kun Hu, Tainan Hsien (TW)

(73) Assignee: Ying Lin Machine Industrial Col., Ltd., Tainan Hsien (TW)

( * ) Notice: Subject to any disclaimer, the term of this patent is extended or adjusted under 35 U.S.C. 154(b) by 141 days.

(21) Appl. No.: 11/001,426

(22) Filed: Nov. 30, 2004

(65) Prior Publication Data

US 2006/0112752 A1 Jun. 1, 2006

(51) Int. Cl.
*B21D 7/025* (2006.01)

(52) U.S. Cl. ..... 72/307; 72/217

(58) Field of Classification Search ..... 72/156, 72/157, 159, 307, 217, 149, 387, 388
See application file for complete search history.

(56) References Cited

U.S. PATENT DOCUMENTS 1,167,538 A * 1/1916 True ..... 72/159
3,147,792 A * 9/1964 Hautau ..... 72/150
3,299,681 A * 1/1967 Hautau ..... 72/14.8
3,373,587 A * 3/1968 Shubin et al. ..... 72/158
3,986,381 A * 10/1976 Shubin et al. ..... 72/217
4,249,407 A * 2/1981 Fogleman ..... 72/217
6,134,932 A * 10/2000 Marque et al. ..... 72/149

* cited by examiner

*Primary Examiner*—Daniel C. Crane

(57) ABSTRACT

A tube bender includes a worktable, a rail on the worktable, a tube-pushing device and a tube-bending device. The tube-pushing device is positioned on the worktable, having a moving base and a clamper at one side of the moving device. The clamper clamps a tube being bent, and a push driver moves the moving base together with the tube work to a preset location. The tube-bending device consists of a base unit, a guide unit and a driving unit, and when the tube work is moved to the tube-bending device, it is bent by the tube-bending device, with a guide roller and a main roller sandwiching the tube for preventing the bent section of the finished tube from disfiguring.

15 Claims, 11 Drawing Sheets

TUBE BENDER

FIELD OF THE INVENTION

This inventin relates to a tube bender, particularly to one provided with a tube pushing device for moving a tube to be bent to a tube bending device, which then performs bending the tube sidewise, and with guide rollers performing bending action so as not to let the bent section disfigure.

BACKGROUND OF THE INVENTION

Conventional tube benders are commonly used for bending tubes, classified into a pull-style and a push-style ones. The pull-style tube bender is provided with a worktable, a control device fixed on the worktable, a tube pushing device positioned on the worktable to move longitudinally, and a pull-style bending device positioned on an end of the worktable. In bending a tube, a tube being bent has its one end clamped tightly in a clamper of the tube-pushing device, and its other end facing toward the tube-bending device. Then the tube being bent is moved in a preset speed by the control device to the tube-bending device. Subsequently, the control device commands a driving unit of the tube-bending device to bend the tube being bent into the preset shape by pulling the bending mold in conjunction with a guide mold.

However, the processes of bending by pulling may easily cause clamping scars and disfiguring to result in disqualified products, because the tube being bent is clamped by the roller unit of the bending device and then clamped by the bending unit of the bending device for carrying out bending action.

A conventional pushing-style tube bender disclosed in an Italian patent No. 1291332 includes a worktable, a controlling device provided on the worktable, and a tube pushing device fixed on the worktable to move longitudinally, au auxiliary pushing device added to the tube pushing device, and a push-style bending device fixed on one end of the worktable. In bending a tube by this tube bender, a tube being bent has its one end clamped by a clamper of the tube pushing device, with the other end facing to the push-style bending device. Then the controlling device commands the tube pushing device to move the tube in a preset speed to the bending device, and then commands the driving unit of the bending device move a bending mold to a preset location of a guide mold, letting the auxiliary pushing device of the tube pushing device push the tube to the bending mold with a large force. Then the bending mold and the guide mold bends the tube into a preset shape by mutual sidewise pushing.

Though the case of the Italian patent can improve the drawback of easy disfigure of a tube after bent, the tube is not actually contact completely to the roller mold of the guide mold in performing bending action, so it is not easy to control the size of the tube after bent, still not so well qualified for producing perfect bent tubes.

SUMMARY OF THE INVENTION

The invention offers a tube bender possessing two functions of bending, having the following features.

1. It is provided with a tube-pushing device fixed on a worktable, a moving base and a clamper beside the moving base. The clamper catches hold of a tube being bend, and the moving base is moved by a push driver to move the tube to a preset location. Further, a tube-bending device is provided, consisting of a base unit, a tube-guiding unit, and a driving unit. The guiding unit has a guide base for supporting a tube being bent, and the driving unit has a guide roller and a main roller driven to rotate.

When the tube pushing device pushes a tube being bent to the bending device, the tube-bending device carries out sidewise bending to the tube with conjunction with the guide mold to prevent the tube from disfiguring of the bent section.

2. Comparing with the conventional pull-style or push-style tube bender, the tube bender in the present invention uses the tube pushing device for pushing a tube being bent to be clamped by the tube bending device fixed on the other end of a worktable, and after that it does not give push force, and the bending mold of the press-style bending device adds force to the tube sidewise, with cooperation of the guide mold, pressing the tube directly and surely in the gap between the guide mold and the bending mold during rotation of the bending mold so as to shape the tube being bent into a bent one so as to get a bent tube having a comparatively correct size, improving the quality of a finished bent tube and the disadvantage that the conventional pull-style or push-style tube bender has.

3. The tube bender in the invention directly uses the press-style bending device for carrying out sidewise bending to a tube, and the tube pushing device is controlled not to supply pushing force to the tube during bending process, so it does not need such an auxiliary device as used in the convention push-style tube bender for the pushing device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
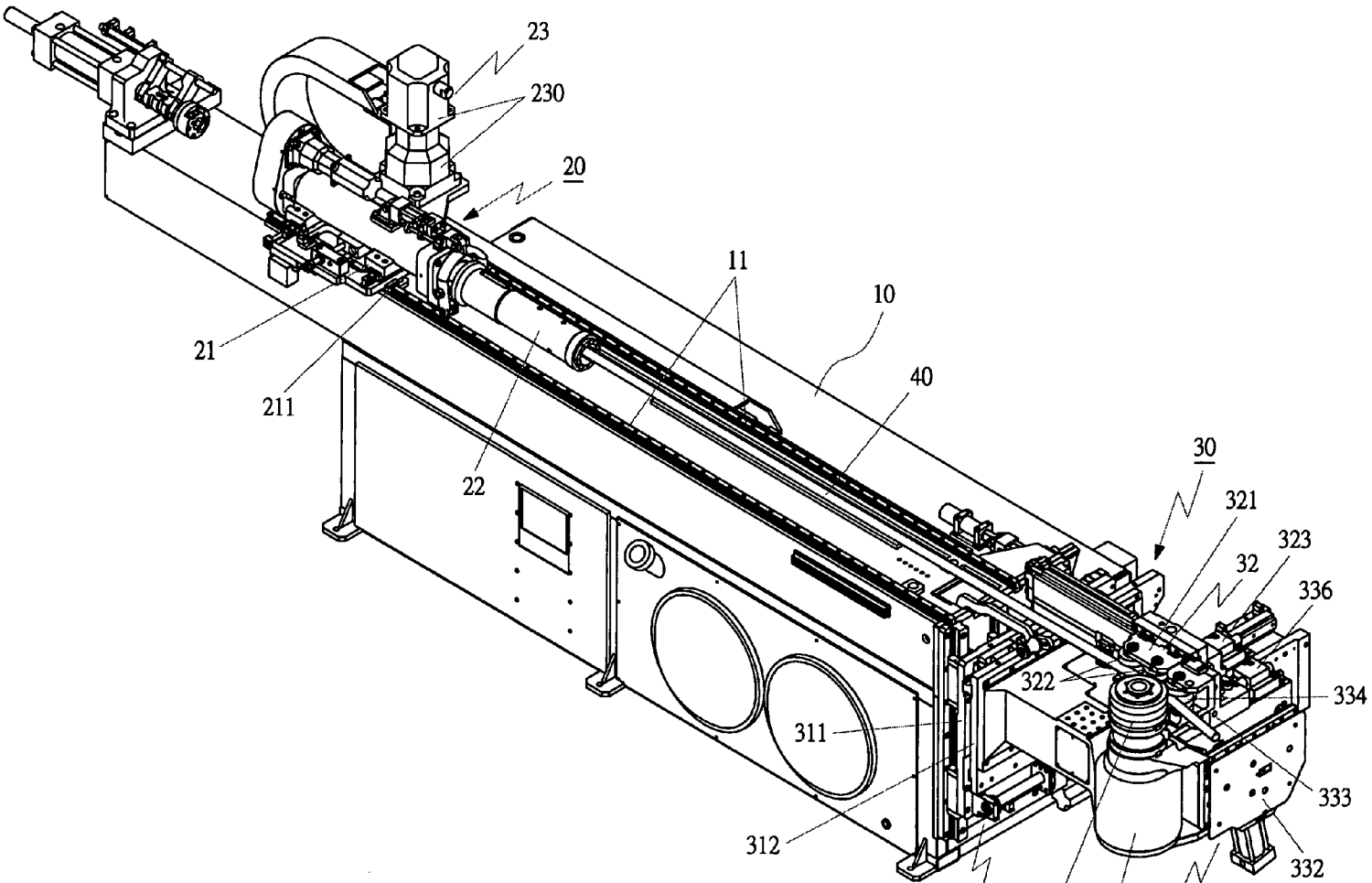
FIG. 1 is a perspective view of a first embodiment of a tube bender in the present invention.
Figure 2:
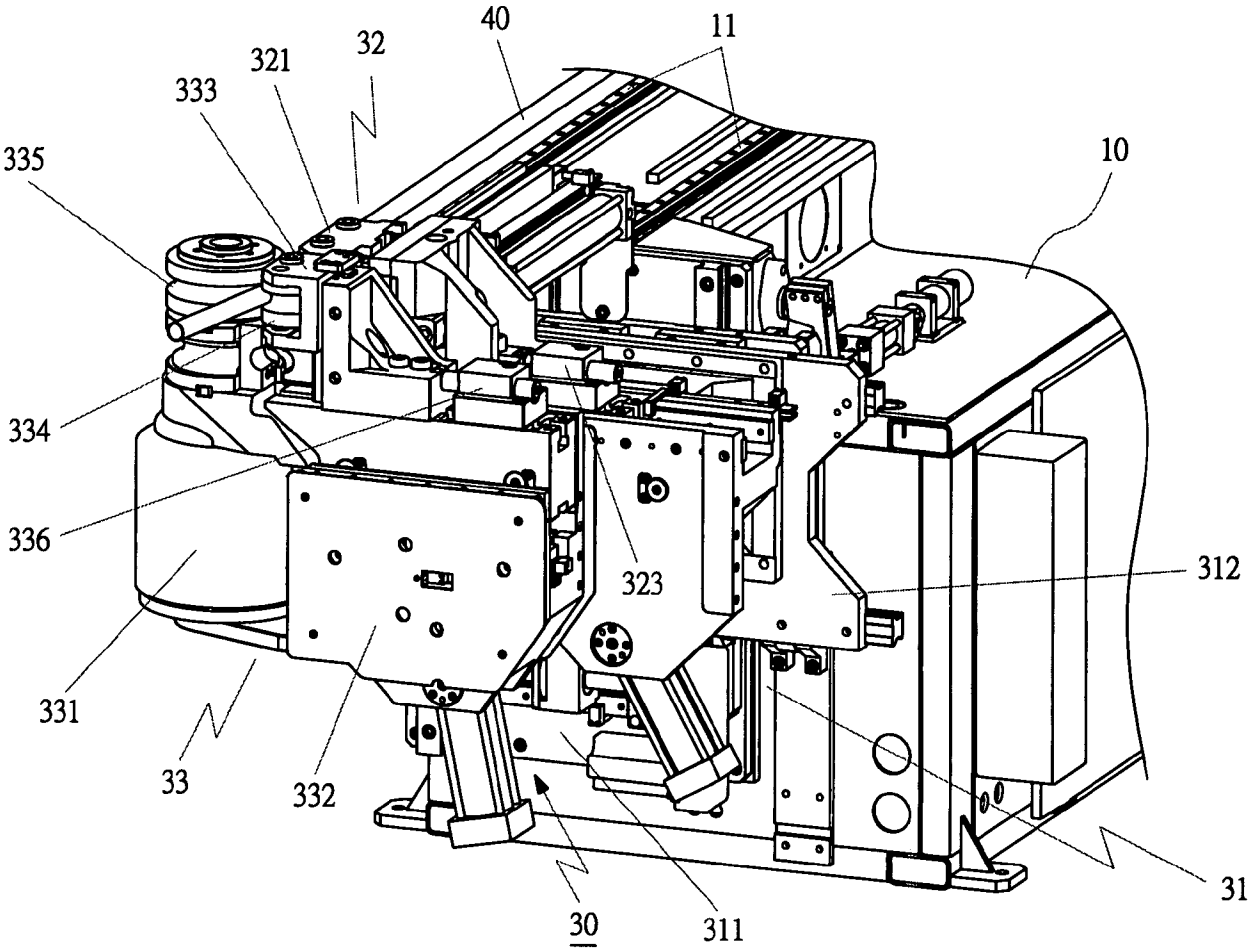
FIG. 2 is a perspective view of a tube-bending device in the first embodiment in the present invention.
Figure 3:
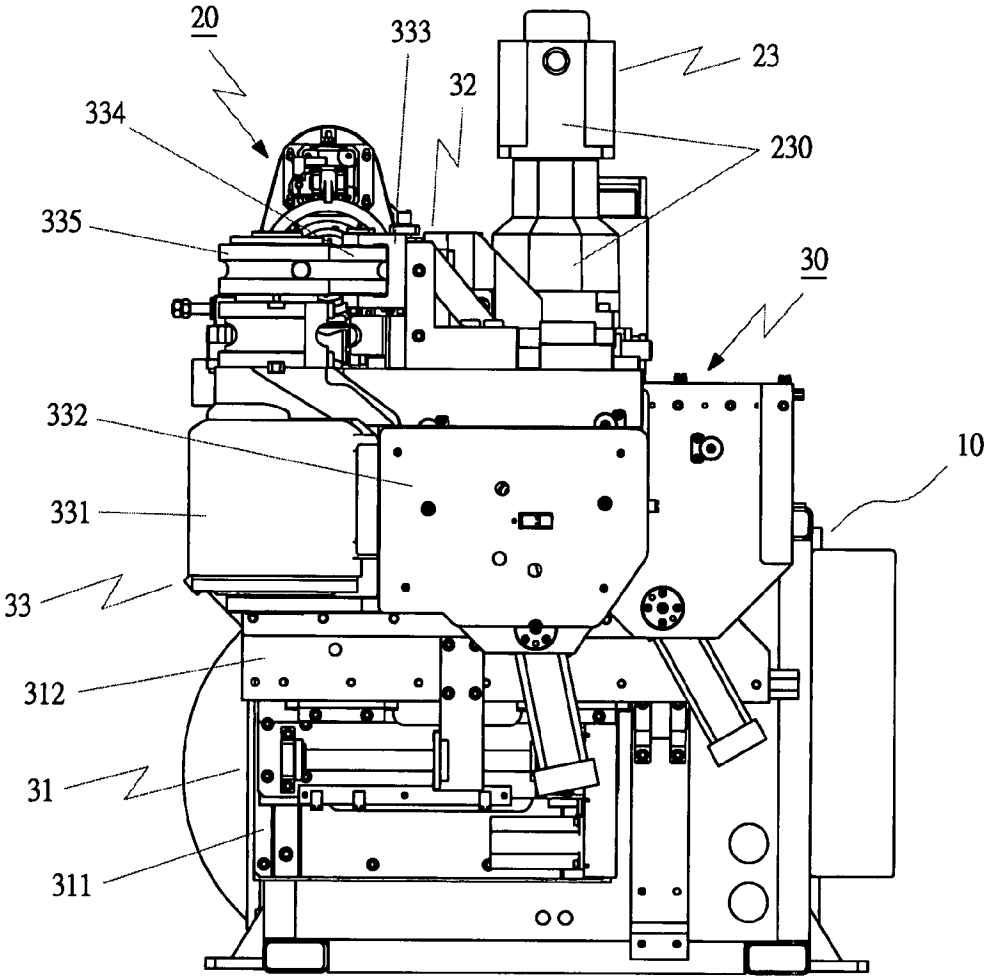
FIG. 3 is a side view of the first embodiment in the present invention.
Figure 4:
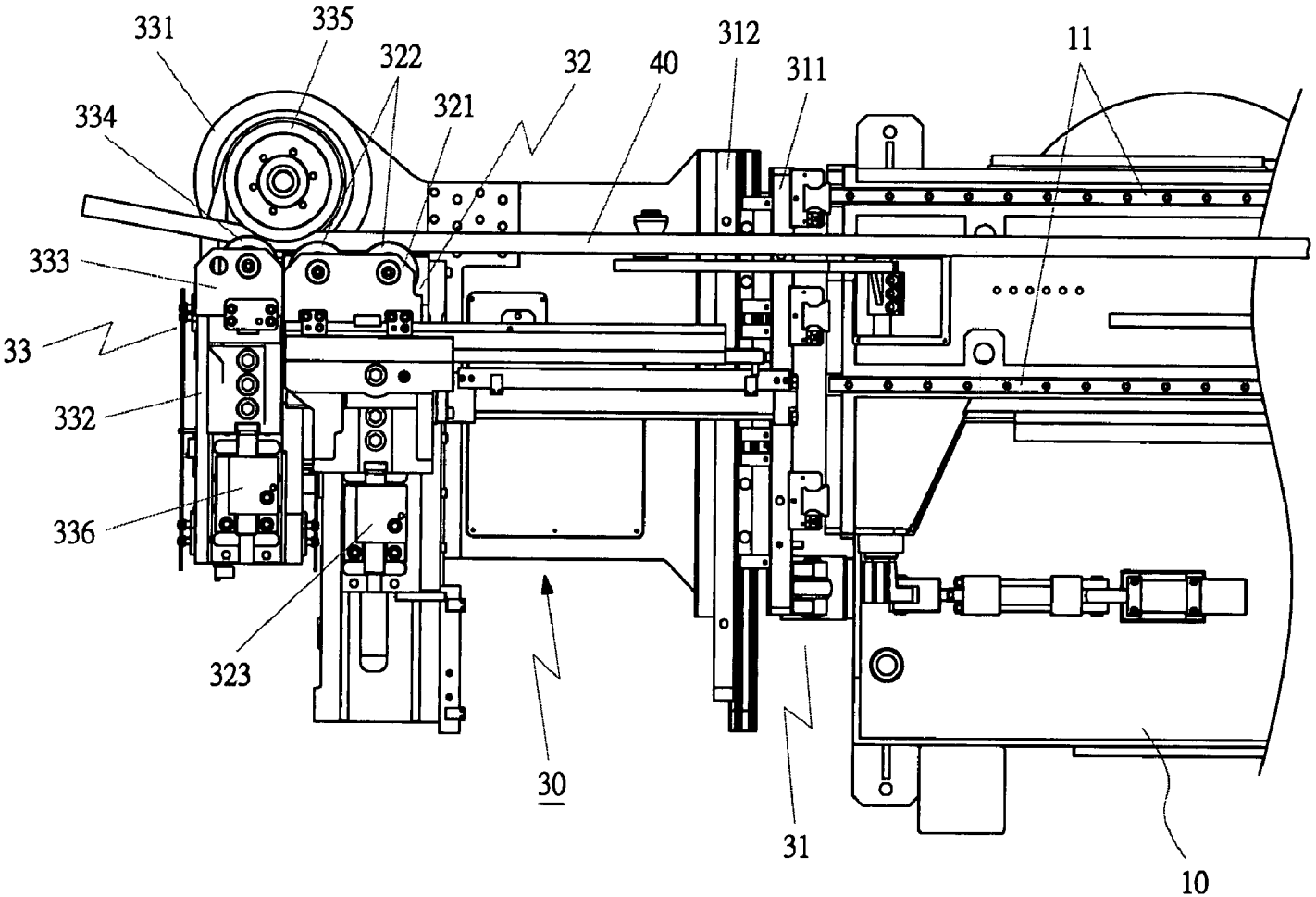
FIG. 4 is an upper view of the first embodiment in a first bending action of a tube in the present invention.
Figure 5:
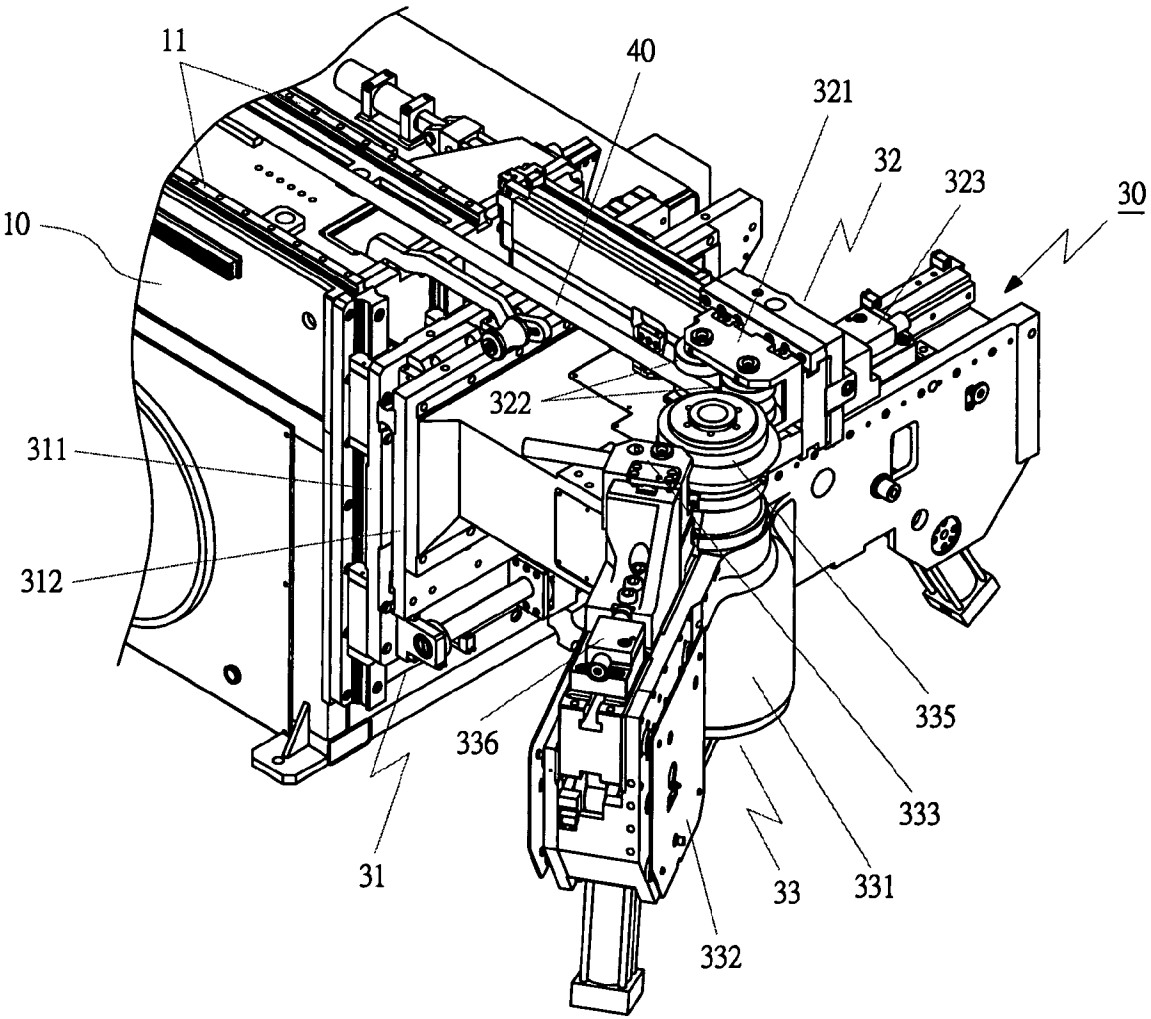
FIG. 5 is a perspective view of the first embodiment in a second bending action of a tube in the present invention.
Figure 6:
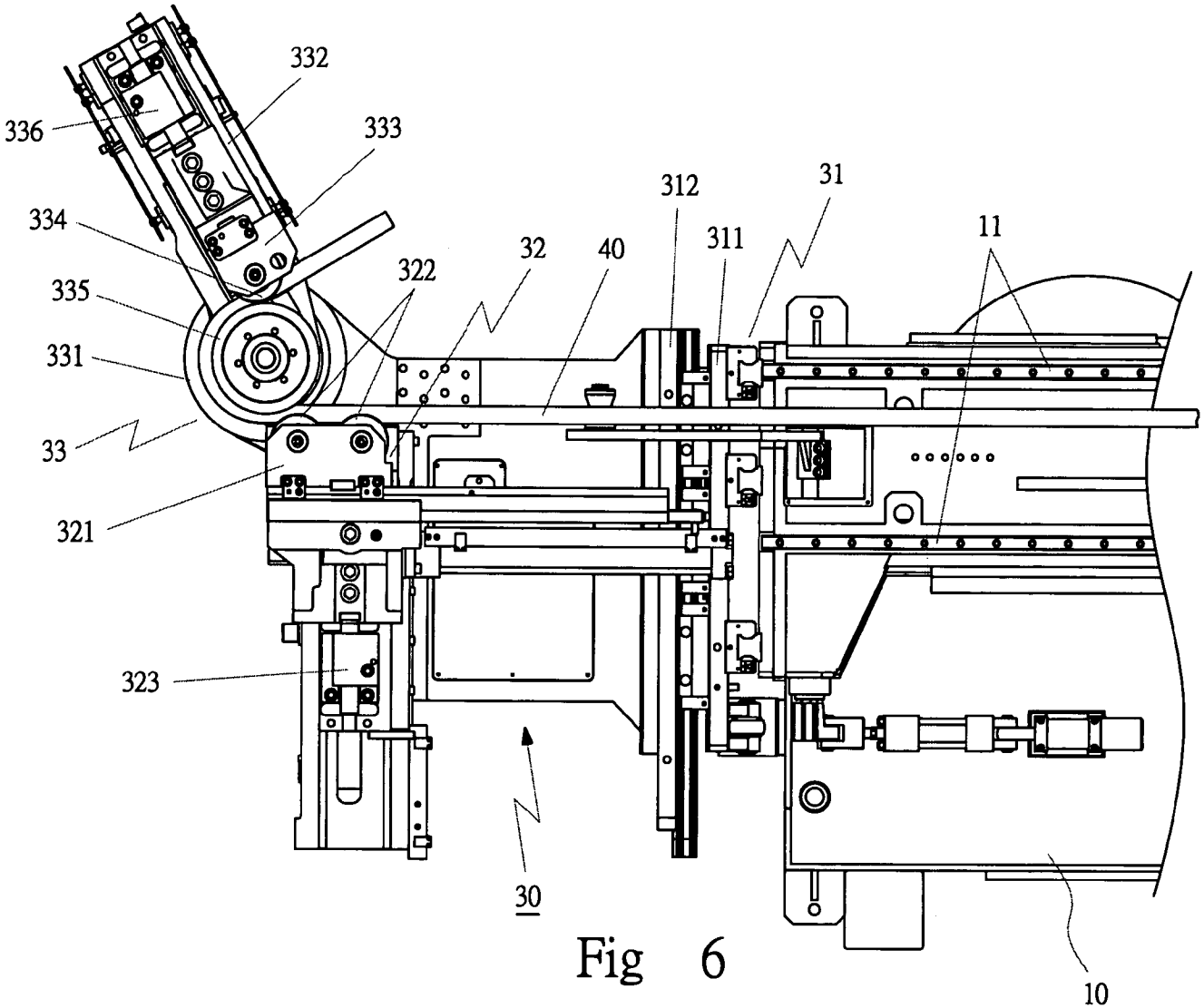
FIG. 6 is an upper view of the first embodiment of a third bending action of a tube in the present invention.

A first embodiment of a tube bender in the present invention, as shown in FIGS. 1, 2 and 3, includes a worktable 10, a tube-pushing device 20, and a tube-bending device 30 as main components combined together.

The worktable 10 has a number-style controlling device (not shown) belonging to a CNC number-style controlling system, and a rail 111 fixed on the worktable 10.

The tube pushing device 20 is positioned on the worktable 10, consisting of a moving base 21, a clamper 22, and a driver 23. The moving base 21 has a rail groove 211 symmetrically provided at two sides and connected with the rail 11 in a dovetail condition to let the moving base 21 to move smoothly on the rail 11. The clamper 22 is located at one side of the moving base 21, controlled by the controlling device for clamping and loosening a tube 40 being bent. The pushing driver 23 is connected with the moving base 21, consisting of a motor and a gear case 230, and using oil pressure or a threaded rod for driving the moving base 21 move along the rail 11.

The tube bending device 30, as shown in FIGS. 2 to 7, is positioned at one side of the worktable 10, consisting of a base unit 31, a guide unit 32 and a driving unit 33.

The base unit 31 is made as stationary or moveable up and down, or movable up and down and also right and left, and in the inventin it is made to move up and down and right and left. The base unit 31 includes a base plate 311 provided at one side of the worktable 10 and possible to be driven to move up and down by a driving device (a well-known art, not shown), a second base plate 312 positioned at an outer side of the first base plate 311 and possible to move right and left by a driving device (a well-known art, not shown). Thus the base unit 31 can be adjusted in its position in a vertical and a horizontal direction.

The tube guide unit 32, referring to FIGS. 2, 5, 6 and 7, is positioned at one side of the base unit 31, consisting of a guide base 321 and one or more auxiliary rollers 322 provided in the guide base 321 with a shaft, or plural parallel auxiliary rollers 322 pivotally connected in the guide base 321, or its side wall formed with a semi-concave to contact with a tube 40 for supporting the tube 40 in the same way as the auxiliary roller(s) 322. Further, an oil pressure cylinder 323 can be provided at one side of the guide unit 32 to connect with the guide base 321 for adjusting the location of the guide unit 32.

Figure 7:
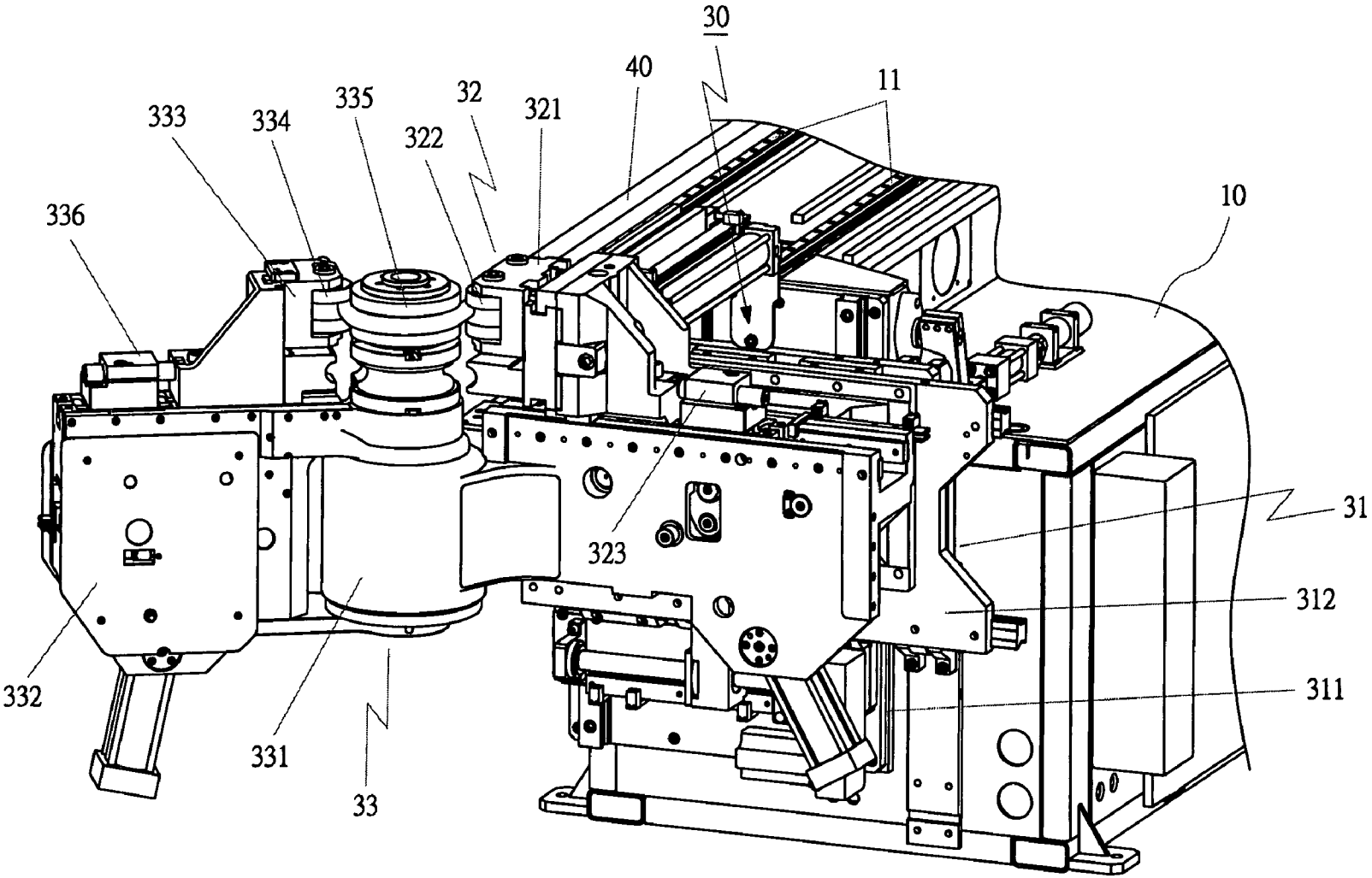
FIG. 7 is a perspective view of the first embodiment of a fourth bending action of a tube in the present invention.
Figure 8:
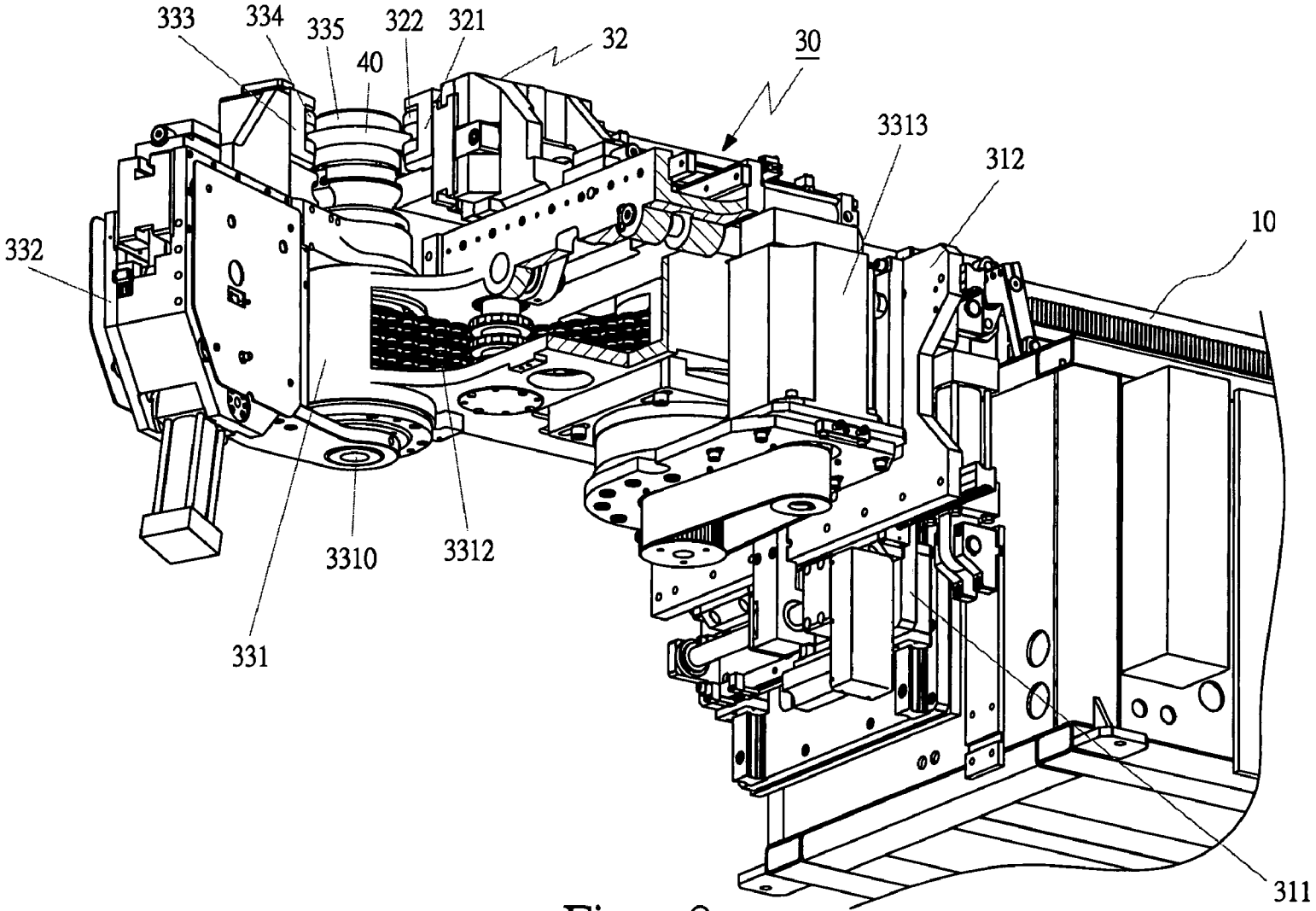
FIG. 8 is a partial perspective view from the bottom of the first embodiment in the present invention.
Figure 9:
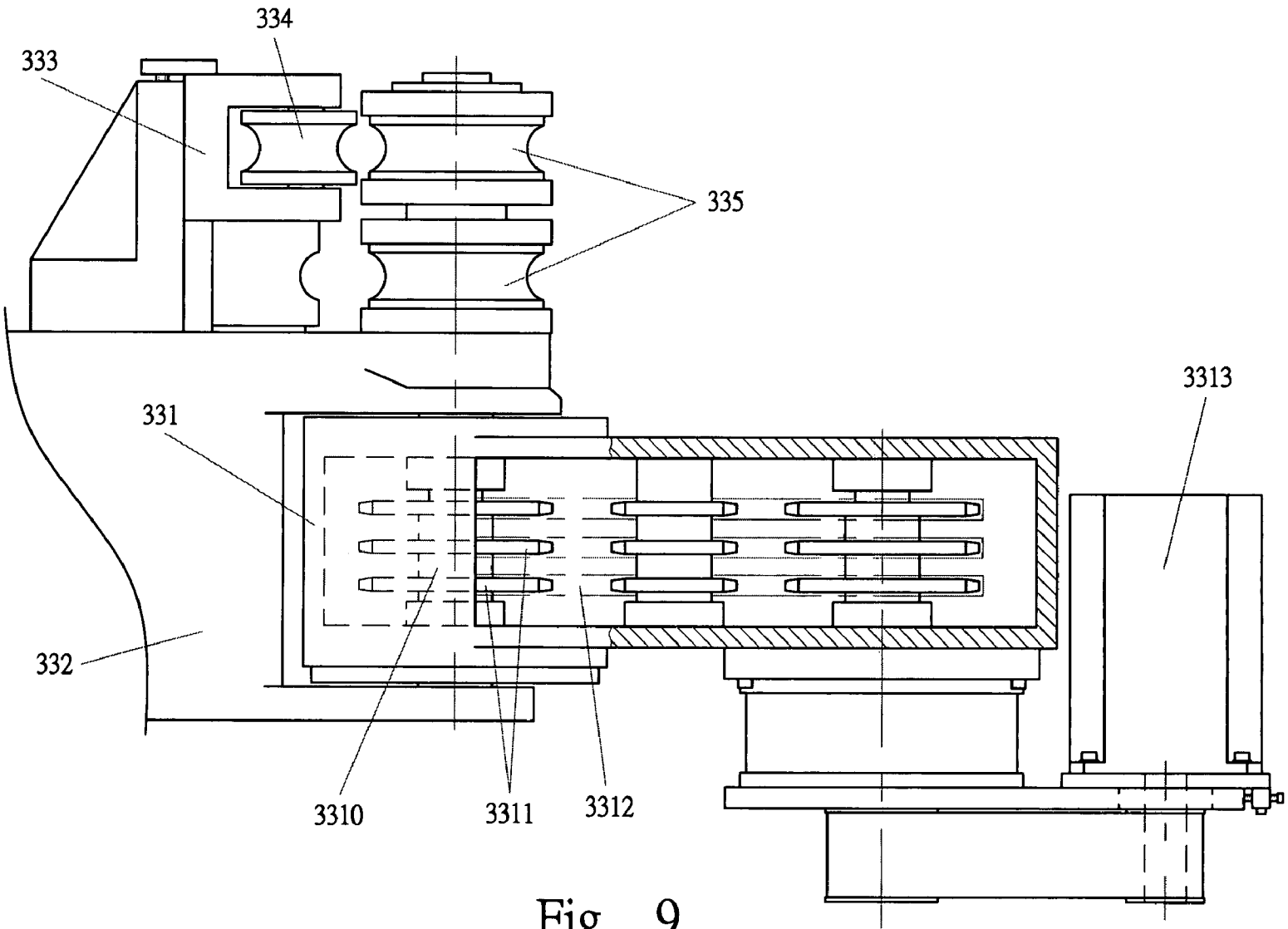
FIG. 9 is a partial upper view of a rotating device in the first embodiment in the present invention.
Figure 10:
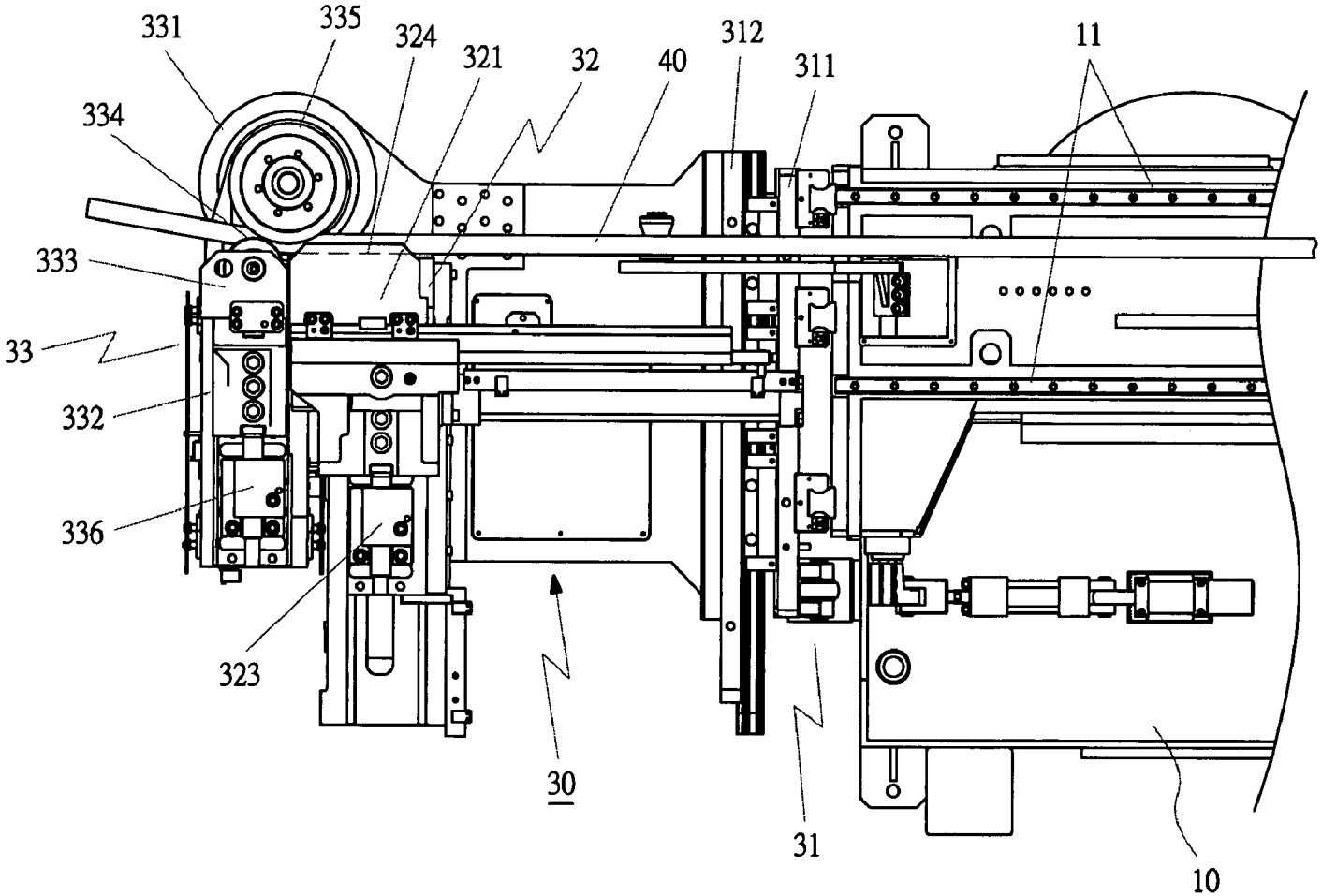
FIG. 10 is an upper view of a second embodiment of a tube bender in the present invention; and, FIG. 11 is a perspective view of a third embodiment of a tube bender in the present invention.

The driving unit 33 is arranged at one side of the base unit 31, consisting of a rotating device 331 as shown in FIGS. 7, 8 and 9. The rotating device 331 has a shaft 3310, one or more chain wheels 3311 fixed on the shaft 3310, and chains 3313 extending around the chain wheels 3311 and driven by a power source 3313. The shaft 3310 is further fixed with a rotatable base 332 for rotating the base 332, and a roller base 333 is fixed with the rotatable base 332 with a main roller 334 pivotally connected. Further, one or more guide rollers 335 are provided on the rotatable device 331, with the main roller 334 and the auxiliary roller 322 located in the same route of bending, and with the guide roller 335 located at the other side of the bending route. Further, an oil pressure cylinder 336 or the same function element is additionally provided at the side of the roller base 333 for adjusting the location of the roller base 333.

A first function of the tube bender in the invention is pressurized bending: In more details, during performing bending of a tube as shown in FIG. 1, the clamper 22 of the tube pushing device 20 clamps an end of a tube work 40 at a starting location on the worktable 10, with the other end of the tube work 40 facing to the tube bending device 30. Next, as shown in FIGS. 4 to 7, the push driver 23 of the pushing device 20 pushes the movable base 21 together with the tube work 40 to the preset location of the bending device 30, and clamped tight by the auxiliary roller 322, the main roller 334 and the guide roller 335. At this time, the pushing device 20 is controlled not to push the tube work 40, and the rotatable base 332 drives the main roller 334 to press against the tube work 40 sidewise, gradually bending the work 40 with cooperation of the guide roller 335 until the work 40 is bent into a preset shaft by rotation of the main roller 334 with the work 40 totally fitting in the gap between the guide roller 335 and the main roller 334. At the same time, the bending device 30 gives sidewise force to the preset bending section of the work 40 so that the functional force may be focused on that bending section for ensuring good quality of the finished bent tube 40.

Figure 11:
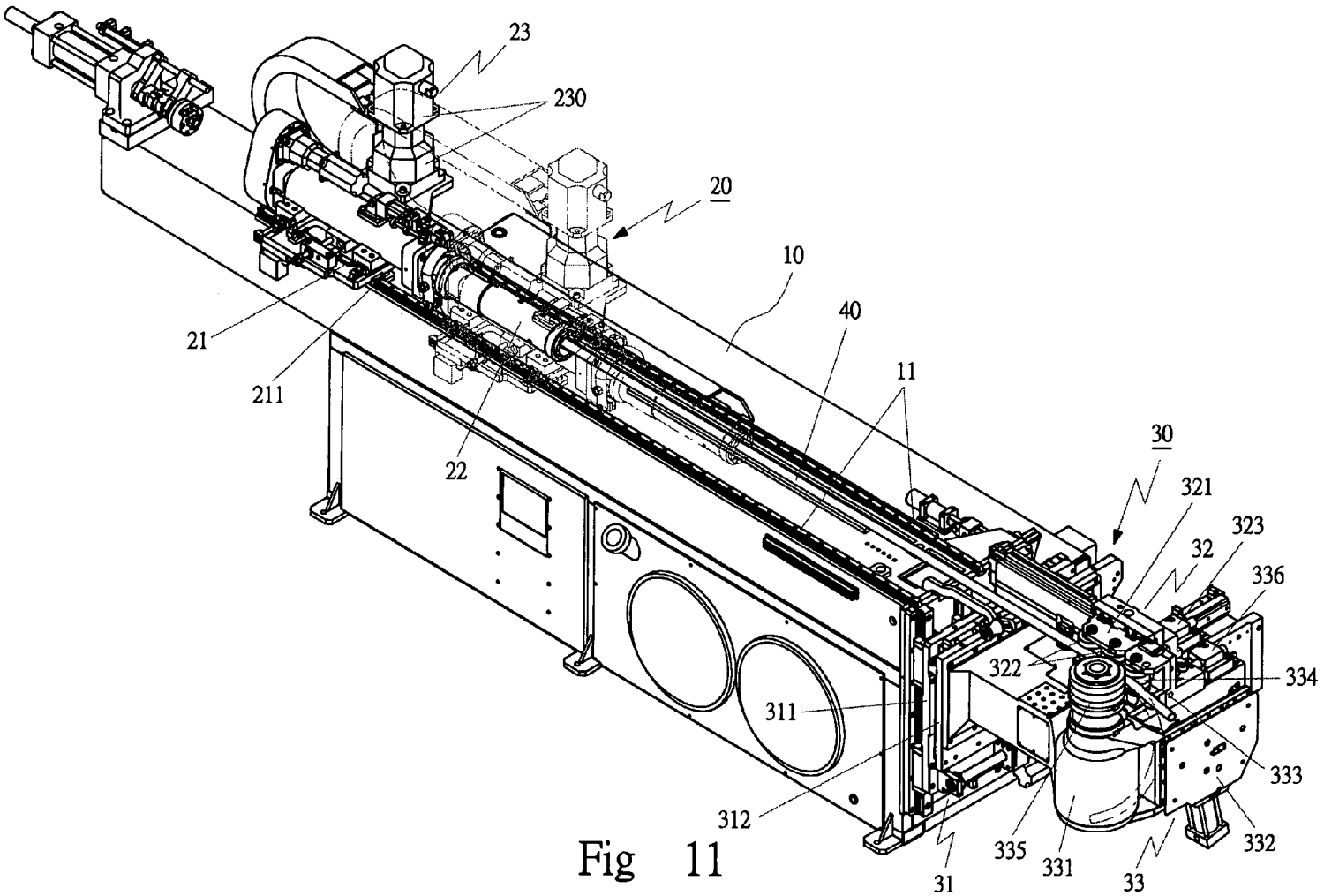

Next, as shown in FIG. 11, a second bending function of the tube bender in the invention is a pushing one, having almost the same as the first function, except that the rotatable base 332 is in advance rotated to a preset location for forming the preset bent shape of the tube work 40, and then the pushing device 20 pushes the tube work 40 forward to the bending device to carry out the subsequent bending process by the auxiliary roller 322, the main roller 334, and the guide roller 335, and so on.

While the preferred embodiments of the invention have been described above, it will be recognized and understood that various modifications may be made therein and the appended claims are intended to cover all such modifications that may fall within the spirit and scope of the invention.

What is claimed is:

1. A tube bender comprising:

a worktable having a rail fixed on its surface;

a tube pushing device provided with a moving base, a rail groove respectively fixed at two sides of said moving base for ensuring said moving base to move along, a clamper provided at one side of said moving base for clamping one end of a tube to be bent, and a push driver connected with said moving base;

a tube bending device positioned at one side of said worktable, said tube bending device comprising a base unit and a guide unit, said base unit having a first plate able to move up and down and a second plate able to move right and left, so that said base unit can be adjusted in its position in a up-and-down direction and a right-and-left direction, said guide unit positioned at one side of said base unit, said guide unit having a guide base and an auxiliary roller connected in said guide base with a shaft; and, a driving unit positioned at one side of said guide unit of said base unit, said driving unit having a rotating device, said rotating device having a shaft driven to rotate by a power source; said rotating device having its shaft fixed with and rotating a rotatable base, said rotatable base having a roller base provided with a main roller connected therein with a shaft, said rotating device further having a guide roller.

2. The tube bender as claimed in claim 1, wherein said guide unit further has an oil pressure cylinder at its one side for connecting with said guide unit of said tube guide unit so as to adjust the location of said guide unit.

3. The tube bender as claimed in claim 1, wherein said guide base of said guide unit has plural auxiliary rollers connected therein with a shaft.

4. The tube bender as claimed in claim 1, wherein said guide base of said guide unit has its sidewall provided with a concave to fit with a tube to be bent.

5. The tube bender as claimed in claim 1, wherein said rotating device has a chain wheel connected therein with said shaft of said rotating device, and a chain extends around said chain wheel, and a power source is provided to drive said chain for rotating said chain wheel.

6. The tube bender as claimed in claim 1, wherein an oil pressure cylinder is positioned at one side of said roller base of said driving unit for adjusting the location of said roller base.

7. A tube bender comprising:

a worktable having a rail fixed on its surface;

a tube pushing device provided with a moving base, a rail groove respectively fixed at two sides of said moving base for ensuring said moving base to move along, a damper provided at one side of said moving base for clamping one end of a tube to be bent, and a push driver connected with said moving base;

a tube bending device positioned at one side of said worktable, said tube bending device comprising a base unit and a guide unit, said guide unit positioned at one side of said base unit, said guide unit having a guide base and an auxiliary roller connected in said guide base with a shaft, said guide unit having an oil pressure cylinder connected at one side of said guide unit for adjusting the location of said guide unit; and, a driving unit positioned at one side of said guide unit of said base unit, said driving unit having a rotating device, said rotating device having a shaft driven to rotate by a power source; said rotating device having its shaft fixed with and rotating a rotatable base, said rotatable base having a roller base provided with a main roller connected therein with a shaft, said rotating device further having a guide roller.

8. The tube bender as claimed in claim 7, wherein said guide base of said guide unit has its sidewall provided with a concave to fit with a tube to be bent.

9. The tube bender as claimed in claim 7, wherein said rotating device has a chain wheel connected therein with said shaft of said rotating device, and a chain extends around said chain wheel, and a power source is provided to drive said chain for rotating said chain wheel.

10. The tube bender as claimed in claim 7, wherein an oil pressure cylinder is positioned at one side of said roller base of said driving unit for adjusting the location of said roller base.

11. A tube bender comprising:

a worktable having a rail fixed on its surface;

a tube pushing device provided with a moving base, a rail groove respectively fixed at two sides of said moving base for ensuring said moving base to move along, a damper provided at one side of said moving base for clamping one end of a tube to be bent, and a push driver connected with said moving base;

a tube bending device positioned at one side of said worktable, said tube bending device comprising a base unit and a guide unit, said guide unit positioned at one side of said base unit, said guide unit having a guide base and an auxiliary roller connected in said guide base with a shaft; and, a driving unit positioned at one side of said guide unit of said base unit, said driving unit having a rotating device, said rotating device having a shaft driven to rotate by a power source; said rotating device having its shaft fixed with and rotating a rotatable base, said rotatable base having a roller base provided with a main roller connected therein with a shaft, said rotating device further having a guide roller, wherein said rotating device has a chain wheel connected therein with said shaft of said rotating device, and a chain extends around said chain wheel, and a power source is provided to drive said chain for rotating said chain wheel.

12. The tube bender as claimed in claim 11, wherein said guide base of said guide unit has its sidewall provided with a concave to fit with a tube to be bent.

13. The tube bender as claimed in claim 11, wherein an oil pressure cylinder is positioned at one side of said roller base of said driving unit for adjusting the location of said roller base.

14. A tube bender comprising:

a worktable having a rail fixed on its surface;

a tube pushing device provided with a moving base, a rail groove respectively fixed at two sides of said moving base for ensuring said moving base to move along, a damper provided at one side of said moving base for clamping one end of a tube to be bent, and a push driver connected with said moving base;

a tube bending device positioned at one side of said worktable, said tube bending device comprising a base unit and a guide unit, said guide unit positioned at one side of said base unit, said guide unit having a guide base and an auxiliary roller connected in said guide base with a shaft; and, a driving unit positioned at one side of said guide unit of said base unit, said driving unit having a rotating device, said rotating device having a shaft driven to rotate by a power source; said rotating device having its shaft fixed with and rotating a rotatable base, said rotatable base having a roller base provided with a main roller connected therein with a shaft, said rotating device further having a guide roller, wherein an oil pressure cylinder is positioned at one side of said roller base for adjusting the location of said roller base.

15. The tube bender as claimed in claim 14, wherein said guide base of said guide unit has its sidewall provided with a concave to fit with a tube to be bent.

* * * * *